US005979280A

United States Patent [19]

Levin et al.

[11] Patent Number: 5,979,280

[45] Date of Patent: Nov. 9, 1999

[54] ELECTRONICS BOARD ASSEMBLY APPARATUS COMPRISING AN INDEXED PUNCH

[75] Inventors: Andrew D. Levin, Aspen, Colo.; Mike A. Witkowski, Banks, Oreg.

[73] Assignee: Intel Corporation, Santa Clara, Calif.

[21] Appl. No.: 09/059,633

[22] Filed: Apr. 13, 1998

[51] Int. Cl.[6] ..... B26D 7/01

[52] U.S. Cl. ..... 83/36; 83/268; 83/276; 83/239

[58] Field of Search ..... 83/36, 209, 238, 83/405, 412, 414, 249, 684, 239, 259, 268, 276, 278, 391, 916, 917, 929.1, 929.2; 29/739, 741, 759, 832, 833, 834, 835, 836, 837, 838, 839

[56] References Cited

U.S. PATENT DOCUMENTS 806,890 12/1905 Harvey ..... 83/239
1,875,080 8/1932 McClintic ..... 83/391
2,763,324 9/1956 Loverch et al. ..... 83/239
2,963,931 12/1960 Lamoureux ..... 83/268 X
3,960,372 6/1976 McElwain ..... 83/391 X

*Primary Examiner*—Rinaldi I. Rada
*Assistant Examiner*—Ana Luna
*Attorney, Agent, or Firm*—Blakely, Sokoloff, Taylor & Zafman LLP

[57] ABSTRACT

The invention provides an electronics board assembly apparatus which includes a base, a slide, an arm, a punch, a bracket, a roller member and at least a first engagement component. The slide is mounted to the base for sliding movement along the base. The arm extends upwardly firm the base and the punch is located on the arm in a position over the slide. The roller member is rotatable mounted to the bracket. Movement of the slide into a first position causes the roller member to come to rest in the engagement surface. The engagement has first and second portions on opposing sides of the roller member when at rest in the engagement surface, the first portion providing less resistance than the second portion against the roller member leaving the engagement surface

13 Claims, 2 Drawing Sheets

ELECTRONICS BOARD ASSEMBLY APPARATUS COMPRISING AN INDEXED PUNCH

BACKGROUND OF THE INVENTION

1). Field of the Invention

This invention relates to a computer board assembly apparatus and, more particularly, to a computer board assembly apparatus which is used for punching components into a substrate for purposes of engaging the components with the substrate.

2). Discussion of Related Art

A computer board comprises a substrate and various components such as buses or the like which are secured to the substrate. The components are often punched to the substrate. For this purpose, an apparatus is utilized comprising a base, a cradle on the base, an arm extending from the base over the base, and a punch located on the arm in a position over the cradle. The substrate and the component are then located on the cradle with the cradle locating the substrate so that the substrate and the component are positioned for a punching operation which is carried out at precisely the correct location by means of the punch.

In certain instances, another component would have to be punched onto the substrate at another location. Another cradle would then be required to position the substrate and the other component so that the punch can carry out a punching operation at the other location.

Interchanging of cradles is a cumbersome operation. An easier way of punching the substrate at two or more different locations is by locating a slide on the base and by providing a system wherein the slide is movable along the base in an indexed manner. Indexing in turn, may provide problems of its own. One such a problem is that the slide may overshoot a specific position required for punching.

The present invention endeavors to provide a solution to this and other problems relating to indexed punching during the manufacturer of computer boards.

SUMMARY OF THE INVENTION

The invention provides an electronics board assembly apparatus which includes a base, a slide, an arm, a punch, a bracket, a roller member and at least a first engagement component. The slide is mounted to the base for sliding movement along the base. The arm extends upwardly from the base and the punch is located on the arm in a position over the slide. The roller member is rotatable mounted to the bracket. Movement of the slide into a first position causes the roller member to come to rest in the engagement surface. The engagement has first and second portions on opposing sides of the roller member when at rest in the engagement surface, the first portion providing less resistance than the second portion against the roller member leaving the engagement surface

BRIEF DESCRIPTION OF THE DRAWINGS

The invention is further described by way of example with reference to the accompanying drawings wherein.

DETAILED DESCRIPTION

An indexed punch and its operation is described. Although the present invention is described with reference to a specific exemplary embodiment, it should be apparent to those skilled in the art that modifications are possible without departing from the scope and spirit of the invention as claimed.

Figure 1:
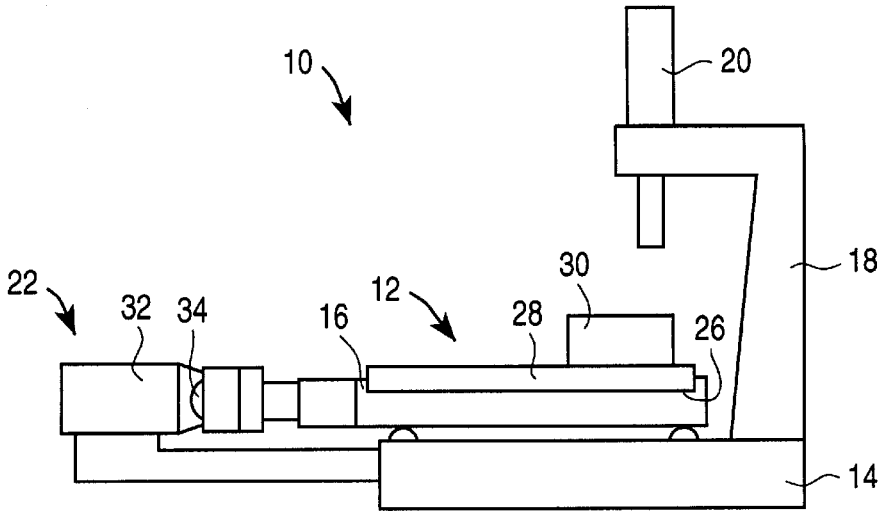
FIG. 1 is a side view of a computer board assembly apparatus according to the invention.
Figure 2:
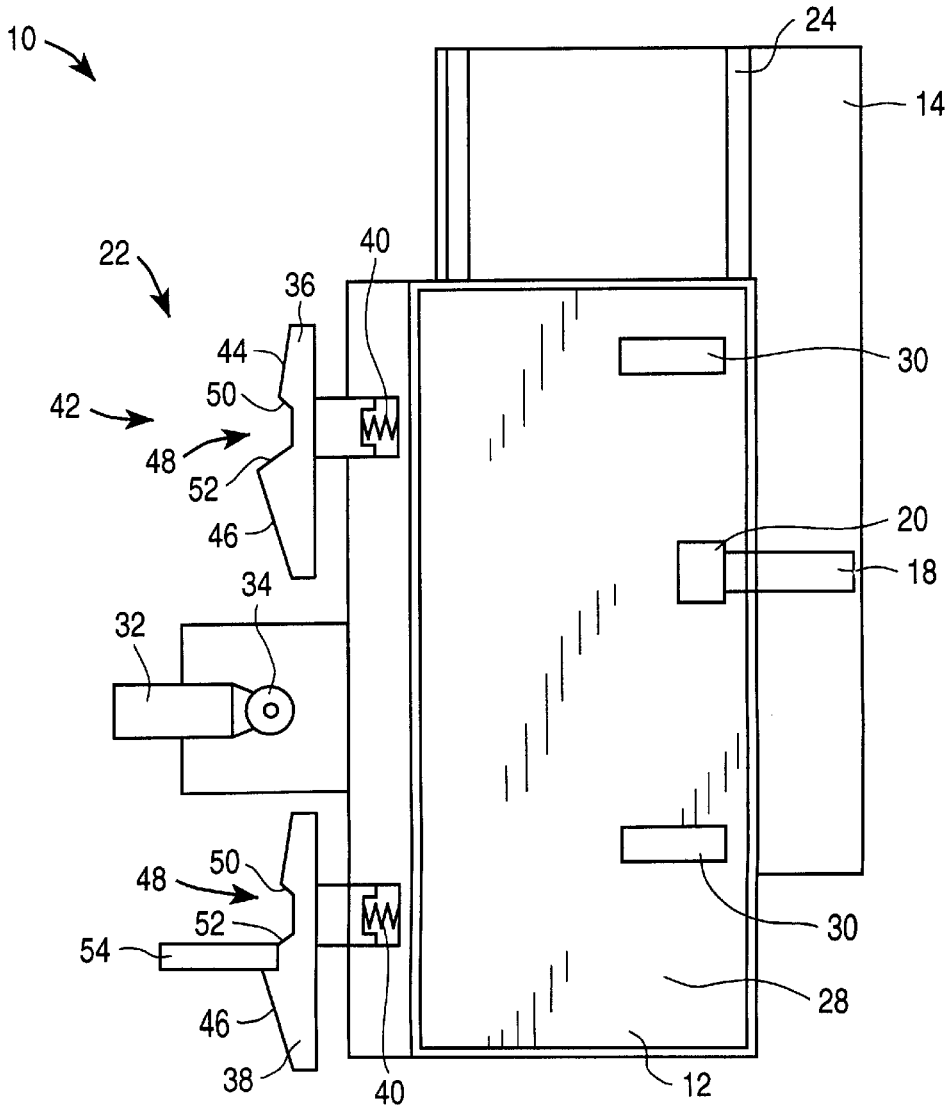
FIG. 2 is a plan view of the computer board assembly apparatus of FIG. 1.

The invention provides an electronics board assembly apparatus which includes a base, a slide, an arm, a punch, a bracket, a roller member and at least a first engagement component. The slide is mounted to the base for sliding movement along the base. The arm extends upwardly from the base and the punch is located on the arm in a position over the slide. The roller member is rotatable mounted to the bracket. Movement of the slide into a first position causes the roller member to come to rest in the engagement surface. The engagement has first and second portions on opposing sides of the roller member when at rest in the engagement surface, the first portion providing less resistance than the second portion against the roller member leaving the engagement surface FIGS. 1 and 2 illustrate a computer board assembly apparatus 10, according an embodiment to the invention, which is used for assembling a computer board 12.

The computer board assembly apparatus 10 includes a base 14, a slide 16, an arm 18 mounted to the base 14 and extending upwardly and over from the base 14, a punch 20 located on the arm 18 in a position over the slide 16, and an indexing system 22.

The slide 16 is mounted to the base 14 on a set of rails 24 so that the slide 16 is slidably movable along the base 14. The slide 16 has an upper surface which is formed with a recess 26 which cradles the computer board 12.

The computer board 12 consists of a substrate 28 and components 30, such as sockets or the like, which have to be secured to the substrate 28 by means of a punching operation.

The indexing system 22 includes a bracket 32 which is mounted to the base 14, a roller ball 34 which is rotatably mounted to the bracket 32, and first and second engagement components 36 and 38, respectively.

The engagement components 36 and 38 are located on the slide 16 and are biased away from the slide 16 by means of springs 40.

Each engagement component 36 or 38 has a surface 42 over which the roller ball 34 rolls when the slide 16 is moved along the rails 24. Each surface 42 includes first and second outer portions 44 and 46, respectively, and an engagement surface 48 between the outer portions 44 and 46 into which the roller ball, comes to rest, preferably in a snapping motion, to retain the slide 16 in position.

The engagement surface 48 has a first inner portion 50 adjacent the first outer portion 44, and a second inner portion 52 adjacent the second outer portion 46. Both inner portions 50 and 52 have relatively steep slopes. The first inner portion 50 is lower than the second inner portion 52. The second engagement component 38 is further formed with a stop 54 between the second inner portion 52 and the second outer portion 46.

The computer board assembly apparatus is used for punching the components 30 at at least two different locations on the substrate 28. In use, the slide 16 is partially pulled from the base 14 until the roller ball 34 is located on a side of the first engagement component 36 which opposes the second engagement component 38. The substrate 28 is then placed on the slide 16 so that the substrate 28 is cradled within the recess 26. The components 30 are then located at two different locations on the substrate 28.

Figure 3A:
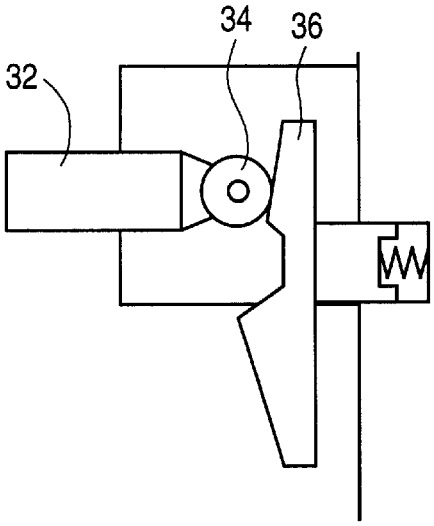
FIG. 3A is a view of an indexing system of the apparatus in a first position.

The slide 16 is then pushed along the rails 24 until the roller ball 34 contacts the first outer portion 44 of the first engagement component 36. The slide 16 is then further pushed so that the roller ball 34 rolls against the first outer portion 44 of the first engagement component 36, causing the first engagement component 36 to deflect against the biasing force of the spring 40 (see FIG. 3A). Since the first outer portion 44 has a very gradual slope, not much resistance is provided against movement of the slide 16.

Figure 3B:
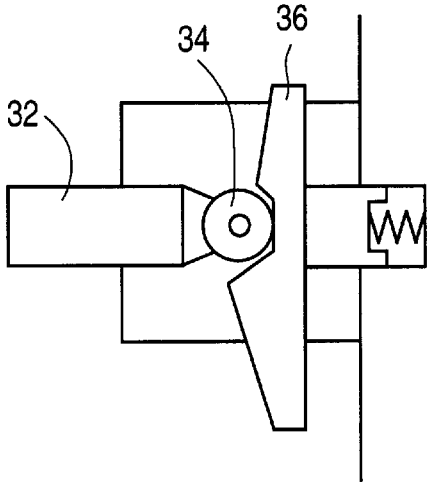
FIG. 3B is a view of the indexing system in a second position.

Further movement of the slide 16 causes the roller ball 34 to come to rest, preferably with a snapping action, in the engagement surface 48 (see FIG. 3B). Because the inner portions 50 and 52 both have relatively steep slopes, the roller ball is prevented from leaving the engagement surface. The second inner portion 52 is higher than the first inner portion 50 so that the second inner portion 52 provides more resistance than the first inner portion against the roller member leaving the engagement surface 48. This prevents the roller member from overshooting the engagement surface 48. The slide 16 and the computer board 12 are now in position for the punch 20 to punch one of the components 30 into engagement with the substrate 28.

Figure 3C:
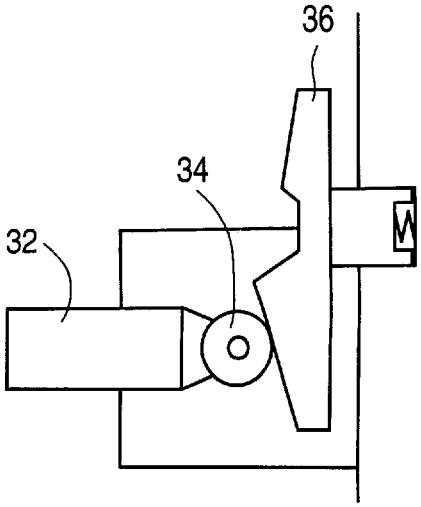
FIG. 3C is a view of the indexing system in a third position.

The slide 16 may then be further pushed along the rails 24 so that the roller ball 34 moves up against the second inner portion 52 to deflect the first engagement component 36 against the biasing force of the spring 40, and down the second outer portion 46 (see FIG. 3C).

Further movement of the slide 16 along the rails 24 will cause the roller ball 34 to move into the engagement surface 48 of the second engagement component 38 in a manner similar as hereinbefore described with reference to the first engagement component 36. The slide 16 is, however, prevented from moving further along the rails 24 by the stop 54 on the second engagement component 38. The slide 16 and the computer board 12 are now in position for the punch 20 to punch the other component 30 into engagement with the substrate 28.

The slide 16 may then again be partially pulled from the base 14 for purposes of removing the computer board 12. Since the first inner portion 50 of each engagement component 36 or 38 is lower than the second inner portion 52, relatively little resistance is provided against movement of the slide 16 by the respective first inner portions 50. In addition, the second outer portion 46 of the first engagement component 36 has a very gradual slope so that the first engagement component 36 deflects easily when the roller ball 34 moves over the second outer portion 46. Pulling of the slide 16 from the base 14 is therefore somewhat smoother than the indexing operation as hereinbefore described when the slide 16 is moved onto the base 14.

Although the present invention has been described with respect to a specific exemplary embodiment, it should be understood that modifications are possible without departing from the scope and spirit of the invention. It may, for example, be possible to have only a single engagement component and two or more roller balls which snap into the engagement component when the slide is located at two different locations on the base 14. It may also, for example, be possible to have the roller ball 34 located on the slide and to the engagement component mounted to the base.

What is claimed:

1. An electronics board assembly apparatus which includes:

a base;

a slide which is mounted to the base for movement along the base;

an arm mounted to and extending upwardly from the base;

a punch located on the arm in a position over the slide;

a bracket;

a roller member which is rotatably mounted to the bracket; and at least a first engagement component having a first engagement surface, wherein movement of the slide into a first position causes the roller member to come to rest within the engagement surface, the engagement surface having first and second portions on the opposing sides of the roller member when at rest in the engagement surface, the first and second portions having heights transverse to the direction of movement of the slide along the base so that both the first and second portions, while still allowing for movement of the roller member over them, provide resistance against the roller member leaving the engagement surface, the height of the first engagement surface being lower than the height of the second engagement surface so that the first portion provides less resistance than the second portion against the roller member leaving the engagement surface.

2. The electronics board assembly apparatus of claim 1 wherein the engagement component is mounted to the slide and the bracket is mounted to the base.

3. The electronics board assembly apparatus of claim 1 wherein the engagement component deflects to allow the roller member to snap into the surface.

4. The electronics board assembly apparatus of claim 1 which includes:

a second engagement component having a second engagement surface, wherein movement of the slide into a second position causes the roller member to snap into engagement with the second engagement surface.

5. The electronics board assembly apparatus of claim 1 which includes:

a stop which disallows the roller member from leaving the engagement surface.

6. An indexing arrangement comprising:

a base;

a slide which is mounted to the base for movement along the base;

a bracket;

a roller member which is rotatably mounted to the bracket; and at least a first engagement component having a first engagement surface, wherein movement of the slide into a first position causes the roller member to come to rest in the engagement surface, the engagement surface having first and second portions on opposing sides of the roller member when at rest in the engagement surface, the first and second portions having heights transverse to the direction of movement of the slide along the base so that both the first and second portions, while still allowing for movement of the roller member over them, provide resistance against the roller member leaving the engagement surface, the height of the first engagement surface being lower than the height of the second engagement surface so that the first portion provides less resistance than the second portion against the roller member leaving the engagement surface.

7. The indexing arrangement of claim 6 wherein the engagement component is mounted to the slide and the bracket is mounted to the base.

8. The indexing arrangement of claim 6 wherein the engagement component deflects to allow the roller member to snap into the surface.

9. The indexing arrangement of claim 6 which includes:

a second engagement component having a second engagement surface, wherein movement of the slide into a second position causes the roller member to snap into engagement with the second engagement surface.

10. The indexing arrangement of claim 6 which includes:

a stop which disallows the roller member from leaving the engagement surface.

11. A method of assembling an electronics board, comprising the steps of:

placing a substrate on a slide;

placing a component on the substrate;

moving the slide into a first position so that a roller member comes to rest in an engagement surface of an engagement member, the engagement surface having first and second portions on opposing sides of the roller member when snapped into the engagement surface, wherein the first and second portions have heights transverse to the direction of movement of the slide and the height of the first portion is lower than the height of the second portion so that the first portion provides less resistance than the second portion against the ball member leaving the engagement surface; and punching the component into the substrate.

12. The method of claim 11 which includes the step of moving the roller member over the second portion and out of engagement with the engagement surface.

13. The method of claim 11 which includes the step of moving the roller member over the first portion and out of engagement with the engagement surface.

* * * * *